United States Patent [19]

Battersby

[11] Patent Number: 4,869,510

[45] Date of Patent: Sep. 26, 1989

[54] GOLF INSTRUCTION APPARATUS AND METHOD

[75] Inventor: Gary Battersby, Delray Beach, Fla.

[73] Assignee: Robert J. Toski, Boca Raton, Fla. ; a part interest

[21] Appl. No.: 125,218

[22] Filed: Nov. 25, 1987

[51] Int. Cl.[4] ..... A63B 69/36

[52] U.S. Cl. ..... 273/186 R; 273/186 C; 273/191 R

[58] Field of Search ..... 273/186 R, 186 A, 186 B, 273/186 C, 186 D, 187 R, 187 A, 188 R, 191 R, 191 A, 191 B, 192, 183 A, 183 E, 26 R, 26 B, 32 R, 77 R, 35 R, 195 R; 272/102–103; 33/508, 518, 408, 409

[56] References Cited

U.S. PATENT DOCUMENTS 3,583,707 6/1971 Fujimoto ..... 273/187 R
3,806,133 4/1974 Cork ..... 273/192
3,917,281 11/1975 Oppenheimer ..... 273/191 B
4,736,952 4/1988 Taft et al. ..... 273/186 R

*Primary Examiner*—Edward M. Coven
*Assistant Examiner*—S. Passaniti
*Attorney, Agent, or Firm*—Steele, Gould & Fried

[57] ABSTRACT

An apparatus and method are provided for golf instruction in which a flexible guide provides a visual and physical reference for the golf swing. The flexible guide can be adjustably fixed between the first and second end support structure whereby the flexible guide can be positioned between the supports at a plurality of heights and angles relative to the ground. Adjustor structure can engage the flexible guide at a plurality of different points along the length of the flexible guide and can be used to flex the flexible guide in both the vertical and horizontal planes to position the flexible guide for the instruction of a variety of golf shots. A method is provided for using the apparatus to instruct a golfer to make a variety of golf swings.

9 Claims, 5 Drawing Sheets

GOLF INSTRUCTION APPARATUS AND METHOD

BACKGROUND OF THE INVENTION

1. Field of the Invention

This invention relates generally to sports instruction equipment, and more particularly to golf instruction equipment.

2. Description of the Prior Art

A number of devices are available which aim to assist the golfer to improve golfing skills. U.S. Pat. No. 3,679,206 discloses a device for determining proper club alignment and line of swing which uses a pointer element aligned along the line of sight of the ball to the point where the ball is to be hit.

There is a need for a golf instruction apparatus which can be used to instruct the proper path for the golf swing. It additionally would be desirable to have a golf instruction apparatus which would be useful for teaching a variety of golf swings, including driving, irons, chipping and putting. It further would be desirable for the golf instruction apparatus to be adaptable to golfers of different sexes, sizes, and left-handed or right-handed orientations.

SUMMARY OF THE INVENTION

It is an object of the invention to provide a golf instruction apparatus and method which will help the golfer develop a proper golf swing.

It is another object of the invention to provide a golf instruction apparatus and method which can be useful in instructing a variety of different golf swings.

It is still another object of the invention to provide a golf instruction apparatus and method which can be used to instruct golfers of different sexes, sizes, and left-handed or right-handed orientations.

It is another object of the invention to provide a golf instruction apparatus and method which can be used to correct a variety of common flaws in the golf swing.

It is still another object of the invention to provide a golf instruction apparatus and method which is easy to use by the golfer to improve golfing skills.

These and other objects are accomplished by a golf instruction apparatus and method in which a flexible guide means is fixed between first and second end support means. The flexible guide means is preferably adjustably fixed to the end supports such that it can be positioned between the end supports at a variety of heights and angles relative to the ground. The apparatus and method can thereby accomodate a number of different golf strokes as well as golfers of different sexes, sizes, and left-hand or right-hand orientations.

Adjustor structure is provided to engage the flexible guide means at a plurality of points along the length of the flexible guide means, and to flex the flexible guide means in both the horizontal and vertical planes. The adjustor means preferably comprises means to engage the flexible guide means and means to engage the ground or an immovable object so as to fix the flexible guide means in flexure.

The adjustor means preferably comprises means to both pull and to push the flexible guide means. The adjustor means can comprise a rigid engagement member which is operatively connected to the means to engage the ground. The means to engage the ground can comprise a projection that is driven into the ground. The rigid engagement member is capable of pushing or pulling the flexible guide as necessary. The rigid engagement member preferably comprises rigid rod means adjustably mounted to the means to engage the ground whereby the rigid rod means can be positioned at a variety of heights and angles to the ground. The rigid rod means preferably has at one end means to slidably engage the flexible guide means so that the flexible guide means can be engaged at a plurality of points along its length and thereby positioned at plurality of angles and heights relative to the ground and to the end supports.

The adjustor means can alternatively comprise an adjustor cord made from a flexible material that can be attached to the means to engage the ground. The means to engage the ground preferably is a projection that is driven into the ground. The cord can be engaged to the flexible guide means and to the adjustor support by knots, by clips or by other structure which is specifically designed for this purpose.

The flexible guide means preferably comprises a flexible cord that has elastic properties so that the cord will give if struck by an errant swing of the golfer. The flexible guide is preferably adjustably mounted to the end supports so that the flexible guide can be positioned between the supports at a plurality of different heights and angles relative to the ground. The flexible guide preferably has flexible loops at its end which engage notch means on the end supports, although alternative attachment means are possible so that it does not sag. The flexible guide preferably is stretched slightly between the end supports. The end supports preferably comprise stakes which can each have a pointed end that can be driven into the turn. Notches or other structure can be provided on the end supports to facilitate attachment of the flexible guide. A first end support is located generally in the direction of travel of the golf balls hit by the golfer therefore is preferably padded such that errant shots that hit the support lose much of their energy on impact. The risk of injury to the golfer and bystanders from ricocheted balls is thereby reduced. The first end support can also be slanted away from the golfer to direct ricocheted balls away from the golfer.

A club path guide pad can be provided to further assist the golfer in developing a proper swing. The pad provides a visual reference of the proper path of the golf club head along the ground. The pad is preferably also marked with striations which indicate the proper alignment of the golf club face along the ground and through impact with the ball. A putting stroke would have a series of parallel striations, for example. A drive would have a set of striations in a more circular path. Separate pads are preferable, although a single pad can include means for detachably fixing different stroke patterns to the pad. The detachable means could be fashioned from Velcro so that different patterns could be interchanged on the mat for different types of shots.

The flexible guide means can include gradations to indicate the length of the stroke. The golfer would then have a measure by which to practice making strokes of uniform length.

A method is provided which incorporates the apparatus of the invention as a tool to instruct proper golf strokes. A guide is suspended between two end supports and is used to help the golfer find the proper path for a particular golf stroke. The guide is positioned between the end supports in a variety of different configurations depending upon the golf shot that is practiced. The flexible guide would be positioned substantially parallel to the ground and at the height of the golfer's hands when properly positioned for the putting stroke. The golfer's hands are placed adjacent to the flexible guide with the club head extending below the guide. The golfer's hands travel back and forth along the guide to promote the straight back and forth path that is desirable for the putting stroke. Gradations on the guide can be used to help the golfer achieve uniform stroke lengths. A second flexible guide can be provided near the ground to assist the golfer in keeping the club head travelling on a straight path backward and forward. A mat with striations indicating the proper alignment of the club face, substantially perpendicular to the desired direction of travel of the ball, can also be positioned on the ground to assist the golfer in finding the proper club path.

The golfer's hands can be positioned either on the near side or far side of the flexible guide with respect to the golfer's body. A golfer who tends to err away from the body in the stroke would place the hands on the near side of the flexible guide so that outward movement is constrained. Conversely, a golfer who tends to swing inward would place the hands on the far side of the guide so that such movement would be constrained. The flexible guide in either case prevents the golfer from swinging in an improper path.

The guide can be angled with respect to the ground to assist the golfer in finding the proper upward or downward angle for a particular shot. A drive, for example, typically follows a low to high path in the follow through. The ball would be positioned substantially below the guide. The point of attachment to the first end support, toward the target, would be higher than the point of attachment to the second end support or to the adjustor (if in use). The flexible guide would then slope upward from the point of impact with the ball. The golfer uses the guide to find the proper path in the follow through of the drive, from a low point to a high point.

A chip shot, on the other hand, required a downward high to low stroke with little follow through. The guide would be positioned with its attachment on the second end support, away from the target, at a point higher than the point of attachment to the first end support or to the adjustor. The flexible guide would then slope downward from the second end support to the point of attachment of the adjustor, and the point of impact with the ball. Proper positioning of the guide will assist the golfer in finding the proper downward path for the chip shot.

The adjustor means is used to position the flexible guide in both the vertical and horizontal planes. Particularly with respect to the horizontal plane, the adjustor structure can be used to position the flexible guide to accomodate both inward and outward irregularities in the golf stroke. A common error in making a hook shot, for example, is in swinging outward in the follow-through. The adjustor means can be used to position the flexible guide such that it extends outward and away from the golfer in the follow through portion of the stroke. This will permit the golfer to err in the stroke somewhat while also constraining the golfer to a better swing. The flexible guide will be angled away from the golfer in smaller degrees as the golfer progresses in skill. The flexible guide can be positioned to correct a number of other irregularities in the golfer's swing, as well as to improve the swing of an experienced golfer.

A skilled golfer should be able to perform an iron or drive shot with the flexible guide in a substantially straight-lined configuration owing to the fact that the skilled golfer will bring the club from a position behind the body to a position immediately in front of the body, and follow through to a position in front of and behind the body.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
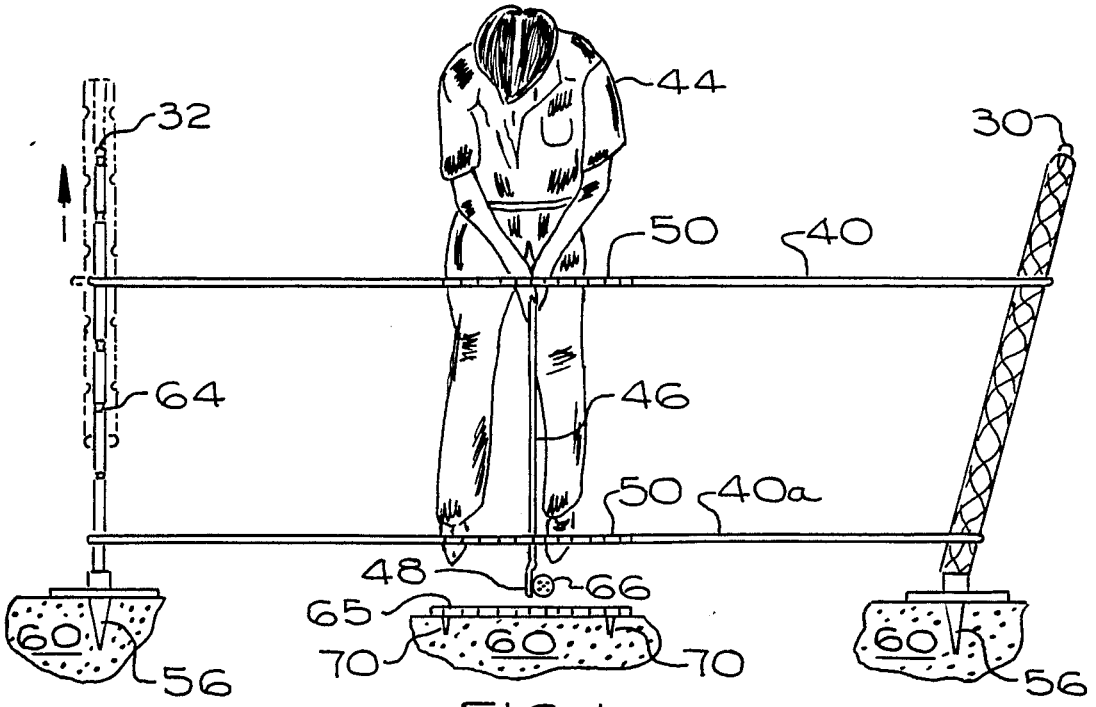
FIG. 1 is a side elevation of a golf instruction apparatus according to the invention in a putting configuration.

Referring to FIG. 1, there is shown a golf instruction apparatus according to the invention configured to assist instruction of a putting stroke. The apparatus consists of a first end support 30 and a second end support 32. A flexible guide 40 is suspended between the end supports and provides a visual indication and physical barrier to direct the hands of the golfer 44. The hands are placed adjacent to the flexible guide 40 and the putting stroke is practiced A correct putting stroke should be substantially parallel to the axis of the golfer's shoulders. Use of the flexible guide 40 as a visual and physical reference will allow the golfer 44 to practice keeping the hands adjacent to the flexible guide throughout the putting motion. The flexible guide 40 or a second guide **40*a* can also be positioned adjacent to ground. The flexible guide 40*a* serves as a visual and physical reference for the path of the golf club 46 with a club head 48. Striations 50 can be provided in the flexible guide 40 and second flexible guide 40*a*. The striations 50** give the golfer a reference to the length of the stroke so that the golfer can work toward attaining an uniform stroke length.

The end supports 30 and 32 preferably are stakes which extend upwardly from the ground. Means for firmly engaging the end supports to the ground are provided. The means for engaging the ground can conveniently be provided as projections 56 which can be driven into the ground 60.

The flexible guide 40 is preferably adjustably engaged to the end supports such that it can be positioned in a variety of heights and angles relative to the ground 60. The ends of the flexible guide 40 can be formed in loops which can be slipped upward and downward on the end supports as desired. Notch portions 64 on the end supports can be provided to firmly retain the flexible guide an position. The flexible guide 40 is preferably elastic and is somewhat stretched between the end supports so that it will not sag and the tension will help to retain it in position. On outer sleeve portion (phantom lines) can be positioned over the shaft 32 and adapted for vertical movement w the respect to the shaft 32. The effective height of the end support is thereby made more adjustable. The outer sleeve can be secured by suitable fastening means such as set screws.

A club path guide pad 65 according to the invention can be placed on the ground adjacent to the golf ball 66 as a visual reference for the proper path of the club head 48. The pad 65 (FIG. 14) includes striations 68 which help the golfer align the club face substantially perpendicular to the axis of the golfer's shoulders. The pad 65 preferably has projections 70 which can be pressed into the ground 60 to firmly retain the pad in place.

Figure 2:
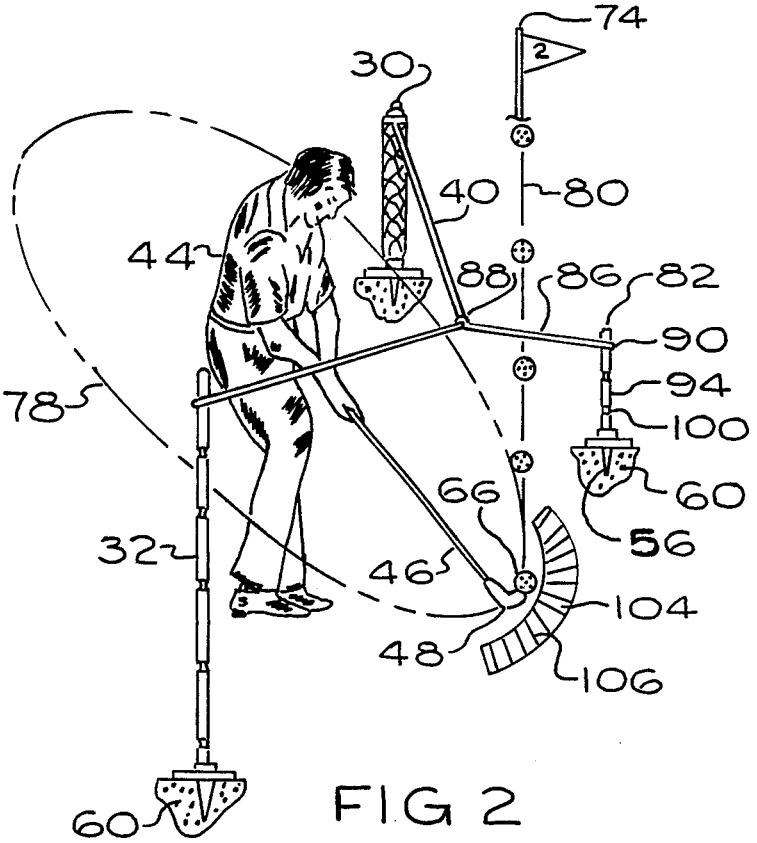
FIG. 2 is a perspective view of a golf instruction apparatus in a straight shot configuration.

The invention is also useful for the instruction of full swings such as the straight shot shown in FIG. 2. The golfer 44 takes aim at the flag 74 and preferably swings the club 46 in the circular path indicated by the dashed line 78 to drive the ball 66 along the straight path shown by the solid line 80. The golfer 44 stands substantially on an imaginary line between the first end support 30 and the second end support 32. The flexible guide 40 is positioned with its end substantially at the topmost portion of the end supports. The ball 66 is positioned in front of the golfer's body.

Adjustor structure is used to engage the flexible guide 40 at a plurality of points along the length of the flexible guide 40. The flexible guide 40 can thereby be positioned in a variety of angles in the horizontal and vertical planes. The adjustor 82 includes a cord 86 with a loop 88 at one end adapted to at least partially encircle the flexible guide 40. The opposite end 90 of the cord 86 is engaged to structure for engaging the ground 60. This structure can be a stake 94. The stake 94 has a projection 56 which allows it to be driven into the ground to firmly retain the adjustor 82 in position. Notches 100 can be provided in the stake 94 to permit the cord 86 to be adjustably positioned on the stake 94.

The adjustor 82 can be used to position the flexible guide 40 in a variety of different heights and angles with respect to the ground. The stake 94 can be moved about relative to the end supports 30 and 32. The cord 86 can be moved to engage the flexible guide at a plurality of points along its length. The cord 86 can be vertically adjusted by engaging a notch 100 at the height that is desired. The proper position of the adjustor 82 and flexible guide 40 for a golfer will depend upon the particular characteristics of the golfer such as height, reach, as well as for the particular characteristics of the golfer's swing. The proper positioning of the adjustor 82 and flexible guide 40 can best be accomplished with the aid of a golf instructor, although the individual student can find a proper position with experimentation. A club path guide pad 104 can be placed adjacent the ball 66 to serve as a visual reference for the proper arc of the club head 48 along the ground and through the point of impact with the ball 66. The pad 104 preferably includes striations 106 which indicate to the golfer the proper alignment of the golf club face through impact with the ball 66.

Figure 3:
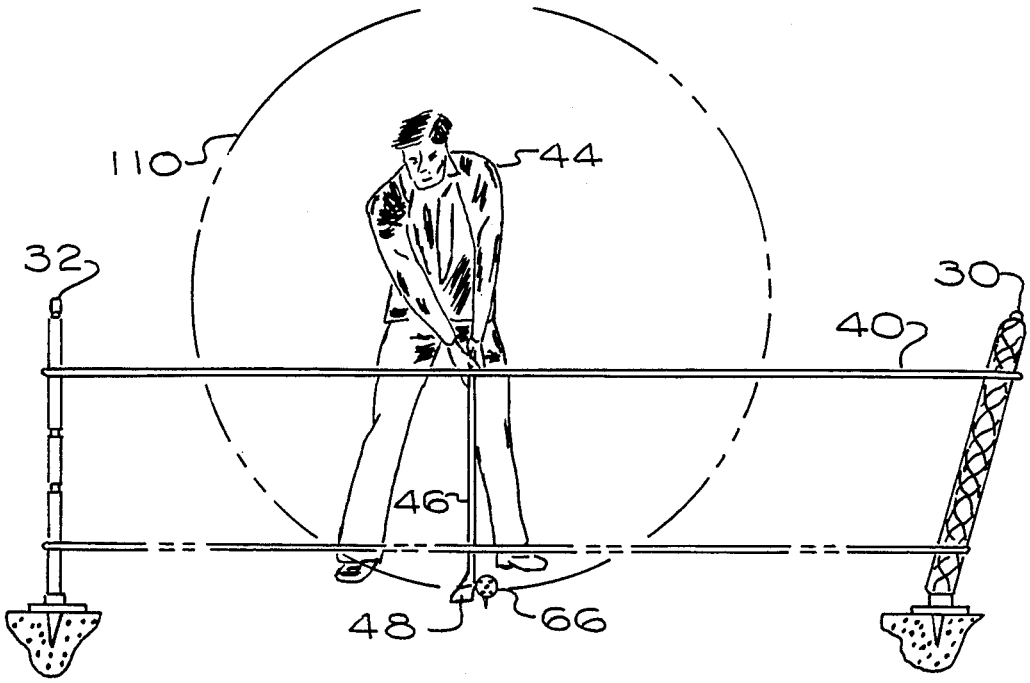
FIG. 3 is a side elevation of a golf instruction apparatus in a driveshot configuration.

The experienced golfer should have a stoke which remains close to the body and will not normally need the flexible guide to be angled, as shown in FIG. 3. The path of the club 46 will generally be oblong in shape as depicted by the dashed line 110. The guide 40 is particularly useful to the experienced golfer to find a proper club height in making straight shots such as chips, pitches and drives. The flexible guide 40 can be positioned substantially at hand level or near the ground (dashed lines in FIG. 3) to provide a visual and physical reference for the experienced golfer to practice keeping the trajectory of the club head 48 low through the point of impact.

Figure 4:
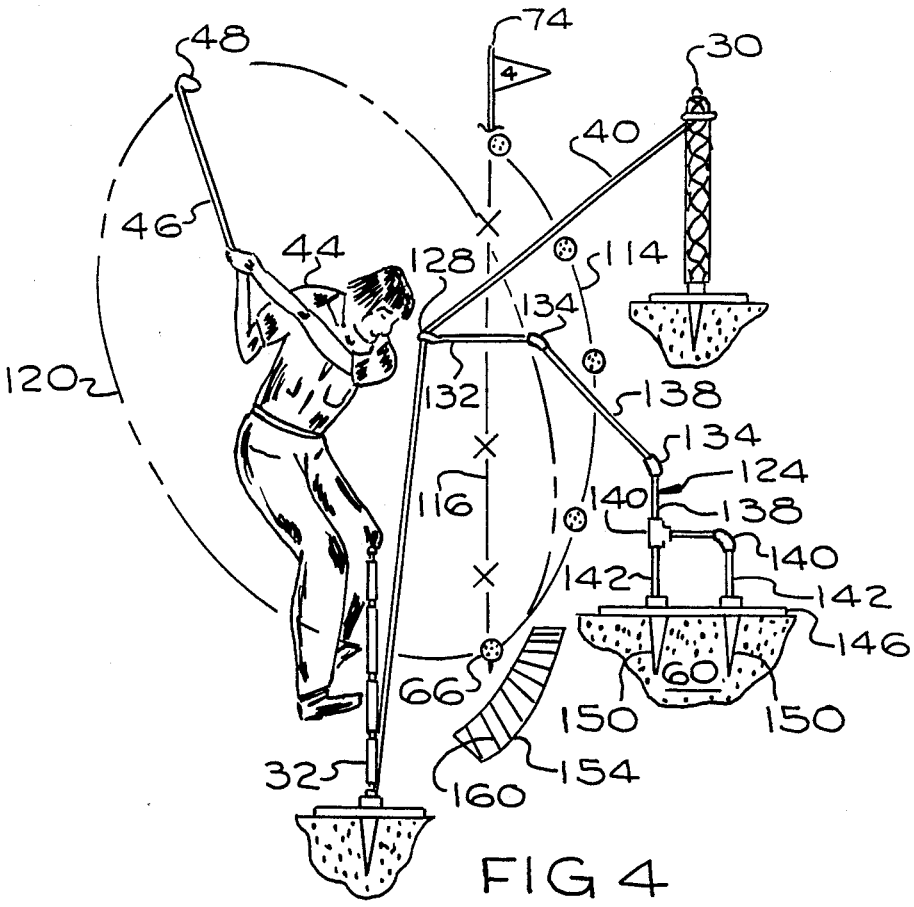
FIG. 4 is a perspective view of a golf instruction apparatus in a hook shot configuration.

The invention can also be used to teach the golfer 44 how to make a proper hook shot, as shown in FIG. 4. The hook shot arcs from right to left for a right-handed golfer as shown by the solid line in 114. The golfer must anticipate the arc to reach the flag 74. A direct path 116 to the flag 74 is usually avoided because of obstructions or hazards that are positioned along this path.

The golfer preferably makes an oblong swing with the club 46 as indicated by the dashed path 120. A common error that is made by the inexperienced golfer is to swing away to close to the body on the follow through portion of the golf stroke. The golfer stands next to the invention with the flexible guide 40 in a substantially straight line alignment with the shoulders in the downward portion of the stroke to force the golfer to keep the club close to the body in this portion of the stroke. A down swing that errs too far from the body would contact the flexible guide 40. It is desirable to angle the flexible guide 40 away from the golfer's body in the follow through portion of the stroke to permit the golfer to follow the flexible guide 40 away from the body.

Alternative adjustor structure 124 is provided which is capable of pushing the flexible guide 40. The golfer 44 stands opposite the adjustor 124 with the ball 66 substantially in front of the golfer's body and the engagement means 128 of the adjustor 124. The shoulders of the golfer are substantially parallel to the portion of the flexible guide 40 extending from the engagement means 128 of the adjustor 124 to the second end support 32. The flexible guide 40 has been pushed by the adjustor out of its straight-line alignment between the first end support 30 and second end support 32 such that the flexible guide 40 angles away from the golfer from the engagement means 128 of the adjustor 124 to the first end support 30. The golfer's 44 is thereby permitted to swing the club 46 slightly away from the body in the follow-through portion of the stroke. The angle at which the flexible guide 40 angles away from the golfer beyond the engagement means 128 can be gradually reduced as the golfer 44 gains experience.

The flexible guide engagement means 128 preferably comprises a loop portion which slidably engages the flexible guide 40 such that the adjustor can be positioned at a plurality of points along the length of the flexible guide 40. A rigid member such as the rod 132 connects the flexible guide engagement member 128 to the rest of the adjustor 124. One or more detachable couplings 134 and extension shafts 138 can be used to position the flexible guide engagement member 128 so as to position the flexible guide 40 at a plurality of heights and angles relative to the ground. A support framework consisting of couplings 140 and shafts 142 can be secured to a base 146 for extra rigidity. The base is preferably held in place by projections which firmly secure the adjustor 124 to the ground 60. The base 146 can alternatively be weighted to secure the adjustor 124 in place.

Figure 12:
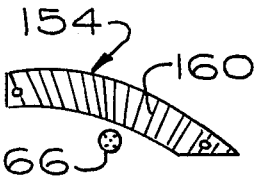
FIG. 12 is a plan view of a club path guide pad according to the invention.

A club path guide pad 154 can be positioned adjacent the ball 66. The club path guide pad 154 (FIG. 12 is preferably arced to indicate the proper path of the golf club head 48 along the ground. The guide path pad 154 further includes a number of striations 160 (FIG. 12) which provide a visual indication of the proper alignment of the frame of the club head 48 through the impact with the ball 66.

Figure 5:
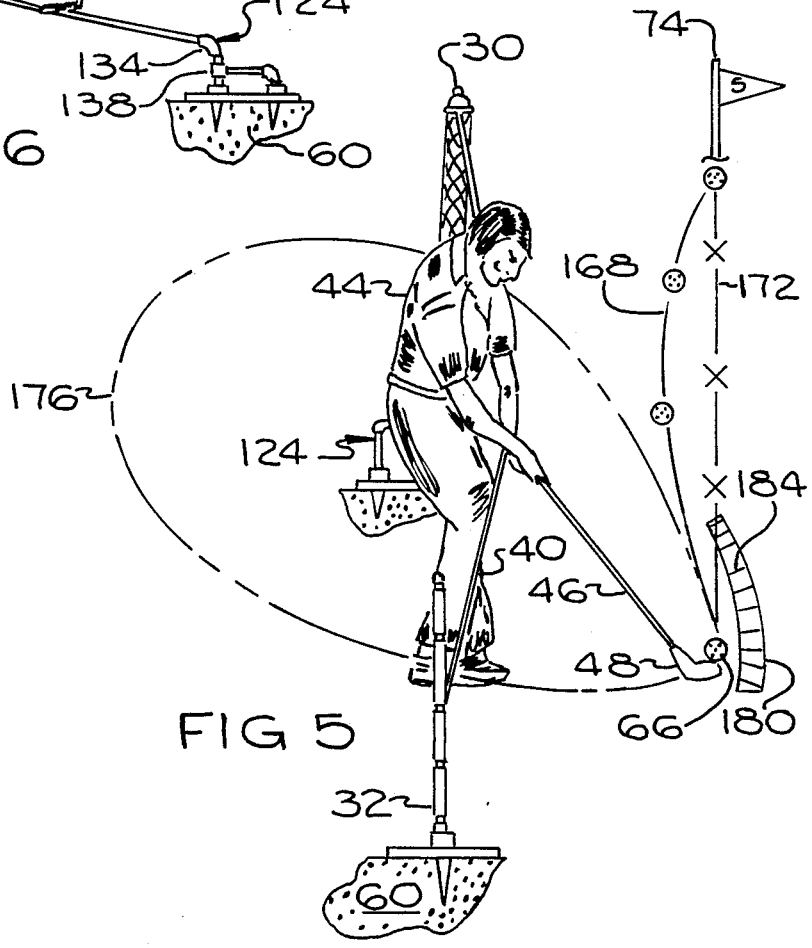
FIG. 5 is a perspective view of a golf instruction apparatus in sliceshot configuration.

The apparatus of the invention can be configured to teach the golfer 44 to make a proper slice shot, as shown in FIG. 5. A slice shot curves from left to right for the right-handed golfer as shown by the solid path 168. The shot is often useful to avoid obstructions and hazards along the straight-line path 172 (dashed line in FIG. 5) between the ball 66 and the flag 74. Inexperienced golfers in attempting to slice commonly err by swinging the club 46 too far from inside the straight-line path 172 to outside the straight-line path 172. The apparatus of the invention can be configured to correct this problem by positioning the golfer 44 with the shoulders substantially parallel to the flexible guide in its alignment between the second end support 32 and the adjustor 124. The shoulders of the golfer to be substantially parallel to the straight path 172. The golfer 44 stands beside the adjustor 124 with the hands and club over the flexible guide 40. The position of the hands and club will force the golfer to keep the downward portion of the stroke away from the body. A golfer who errs by swinging the club too close to the body will contact the flexible guide 40. The golfer preferably swings the club 46 on an oblong path shown by the dashed line 176. The placement of the golfer's hands and club 46 over the flexible guide 40 provides a physical and visual reference to help the golfer correct for the common problem of bringing the swing too close to the body.

The first end support 30 is positioned substantially behind the axis of the shoulders of the golfer 44 so that the flexible guide 40 angles behind and away from the golfer 44 from the adjustor 124 to the first end support 30. This configuration of the apparatus permits the inexperienced golfer to swing toward the body in the follow through portion of the stroke. The angle of the flexible guide 40 away from and behind the axis of the shoulders of the golfer in the follow through portion of the stroke permits the golfer to use the flexible guide 40 as a visual reference to keep this portion of the stroke well behind the body. Inexperienced golfers typically swing too far in front of the body in the follow through portion of the stroke.

The flexible guide 40 is positioned for the slice shot in an upward configuration from the second end support 32 to the first end support 30 to provide a physical and visual reference for he preferred low-to-high angle of the club 46 in making the slice shot.

A club path guide pad 180 is preferably provided and positioned on the ground adjacent to the golf ball 66. The pad 180 is preferably shaped in an arc that corresponds to the proper path of the club head 48 of the golf club 46 along the ground. The club path guide pad 180 preferably includes striations 184 which provide a visual indication of the proper alignment of the golf club face through impact with the ball 66.

Figure 6:
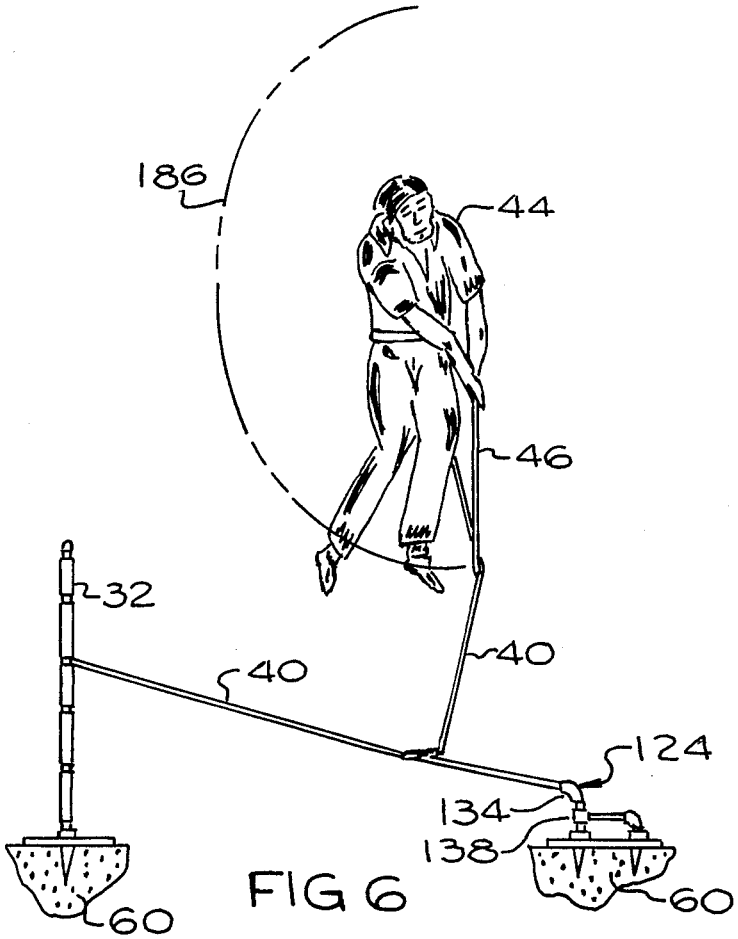
FIG. 6 is a perspective view of a golf instruction apparatus in a chip shot configuration.

The invention is useful for instructing chipping strokes, as shown in FIG. 6. The proper path for the stroke is generally a vertical semicircular path that stops shortly after the point of impact as denoted by the dashed line 186 in FIG. 6. The adjustor 124 is used to hold the flexible guide 40 low to the ground by properly configuring the lengths of the shafts 138 and the angles of the couplings 134. The golfer 44 preferably stands with the axis of the shoulders substantially perpendicular to a portion of the flexible guide 40 near the adjustor 124 and thus low to the ground. The golfer 44 practices driving the club 46 along the semicircular path 186 and into the flexible guide 40. The flexible guide 40 simulates the impact which commonly accompanies the chip shot.

Figure 7:
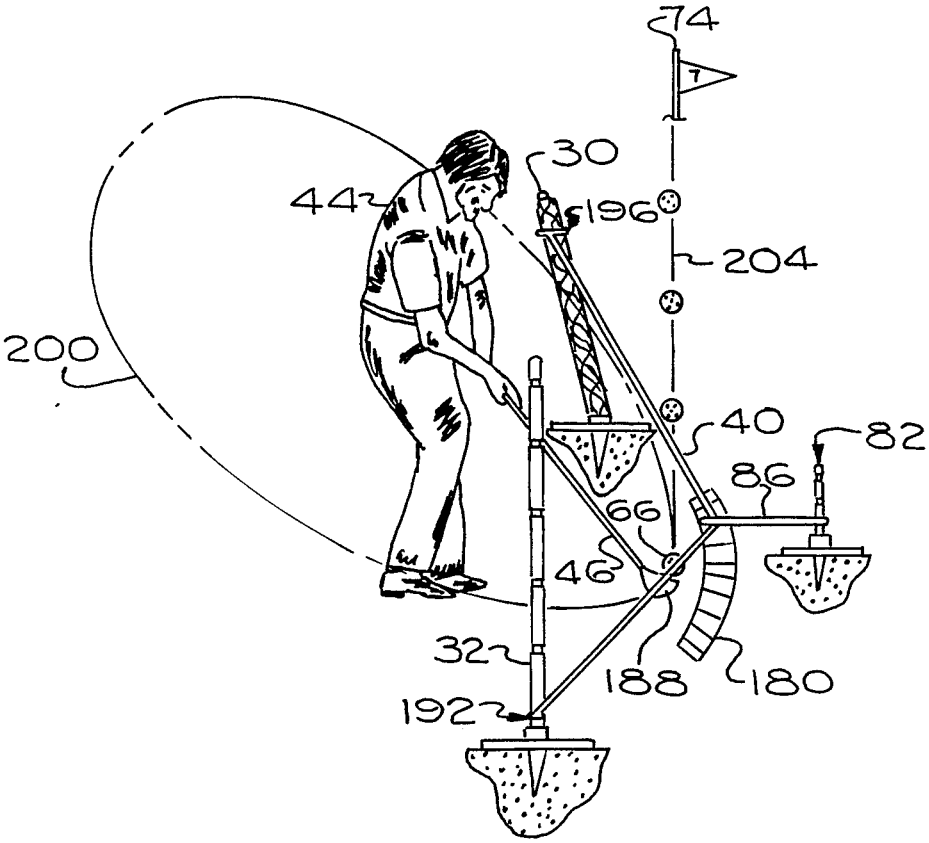
FIG. 7 is a perspective view of a golf instruction apparatus in a drive shot configuration.

The flexible guide 40 can be positioned on the first end support 30 and second end support 32 in a variety of different heights and angles with respect to the ground. A drive shot, for example, is usually made by swinging the club in a motion which emphasizes a low-to-high arc of the driving head. There is shown in FIG. 7 an apparatus according to the invention that is configured to instruct a proper drive. The flexible guide 40 extends upwardly from a low point of attachment 192 on the second end support 32 to a high point of attachment 196 on the first end support 30. The low-to-high configuration of the flexible guide 40 provides a visual and physical reference for the golfer 44 in making a proper drive.

An adjustor 82 can be used to position the flexible guide to provide a reference for the golfer in the proper swing path as indicated by the dashed line 200. The cord 86 flexes the flexible guide 40 away from the golfer 44. The golfer 44 stands with the axis of the shoulders substantially parallel to the direct path 204 from the ball 66 to the flag 74. The golfer 44 stands directly in front of the ball 66 and the adjustor 82. The adjustor 82 angles the flexible guide 40 away from the golfer 44 such that the flexible guide 44 substantially envelopes the proper path 200 of the driver 46 through the point of impact with the ball 66. The flexible guide 40 provides both a physical and visual reference for the golfer 44 in swinging the driver 206 to the point of impact with the ball 66 and through the follow-through portion of the stroke. The club path guide pad 180 can be positioned adjacent the ball 66 to indicate the proper arc of the club head 188 adjacent to the ground and the proper alignment of the club face through the point of impact with the ball 66.

Figure 8:
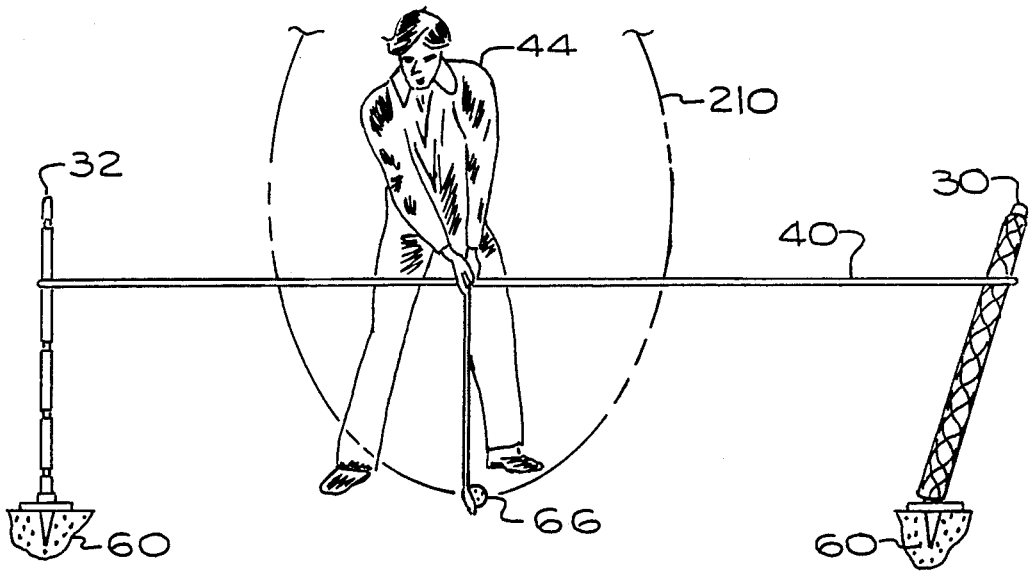
FIG. 8 is a side elevation of the golf instruction apparatus in a short game pitch configuration.

The invention is also useful for instructing strokes for the short game strokes as shown in FIG. 8. The flexible guide 40 is positioned approximately at hand level between the first end support 30 and second end support 32. The golfer 44 stands with the hands over the flexible guide 44 with the ball 66 substantially on the side of the flexible guide 40 opposite the golfer 44. The golfer stands up to the flexible guide 40 with the hands over the flexible guide 40. The golfer 44 can practice making the proper stroke path shown by the dashed line 210. The flexible guide 40 provides both a physical and visual reference to help the golfer 44 make the desired stroke path 210 away from and in front of the body.

Figure 11:
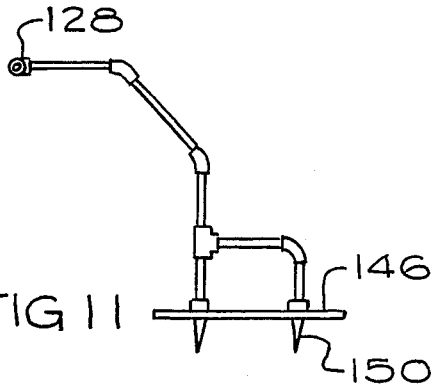
FIG. 11 is a side elevation of adjustor structure in a second configuration.
Figure 10:
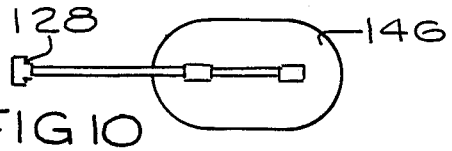
FIG. 10 is a plan view of adjustor structure.
Figure 15:
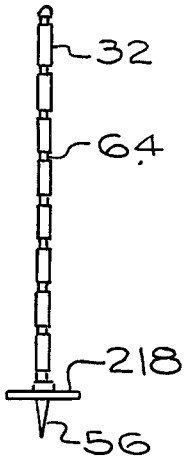
FIG. 15 is a side elevation of the club path guide pad of FIG. 14.
Figure 9:
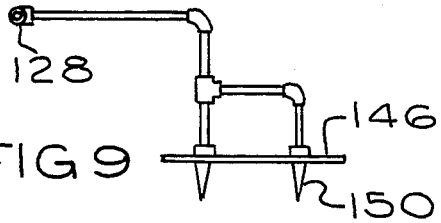
FIG. 9 is a side elevation of adjustor structure according to the invention in a first configuration.

The adjustor 124 (FIGS. 9–11) can be conveniently manufactured from tubular shaft components and couplings. The tubular members and couplings can be held together by detachable means such as pins or the like such that the configuration of the adjustor can be changed In FIGS. 9–10 there is shown what is configured to engage the flexible guide 40 at a relatively low position relative to the ground. The user can change the couplings and member to those of different lengths and degrees to form the adjustor shown in FIG. 11, which engages the flexible guide 40 at a higher position. A variety of shaft lengths and coupling angles can be provided such that the adjustor 124 can be used to position the flexible guide 40 at any of a plurality of different heights and angles relative to the ground. The means to engage the flexible guide 40 preferably is a substantially annular or tubular engagement member 128 adapted to slidably engage the flexible guide 40. The flexible guide 40 is preferably threaded through the tubular engagement member 128. It is also within the invention to provide alternative engagement members. A base portion 146 preferably is provided with projections 150 which are used to firmly engage the ground.

Figure 14:
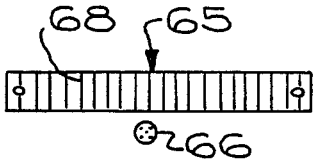
FIG. 14 is a plan view of a third embodiment of a club path guide pad.
Figure 13:
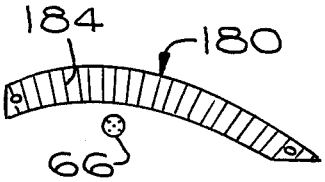
FIG. 13 is a plan view of an alternative club path guide pad according to the invention.

The club path guide pads shown in FIGS. 12—15 are constructed in the shape of the proper arc of the club head along the ground for a particular golf swing It is preferable to provide a separate pad for each type of stroke, such as irons (FIG. 12), drives (FIG. 13), and putting (FIG. 14). It is alternatively possible to provide a single base pad and to attach the pads 65, 154, and 180 to the base pad by detachable means such as Velcro. Projections 214 can be provided on each pad to firmly secure the pads to the ground.

Figure 16:
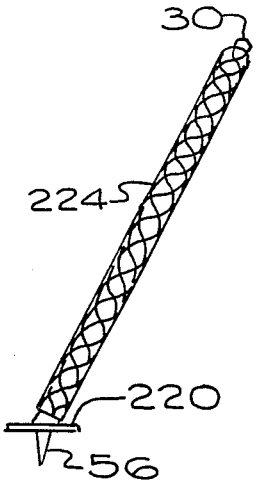
FIG. 16 is a side elevation of a second and support.

The first end support 30 and second end support 32 can be constructed in a variety of configurations. A preferred second end support 32 is shown in FIG. 16. The second end support 32 preferably is an upwardly extending stake or shaft with a projection 56 at one end adapted to be driven into the ground. Notches 64 are adapted to receive the ends of the flexible guide 40 so as to retain the flexible guide 40 at a desired height. A base portion 218 can be provided immediately above the projection 56 to give the second end support lateral stability.

Figure 17:
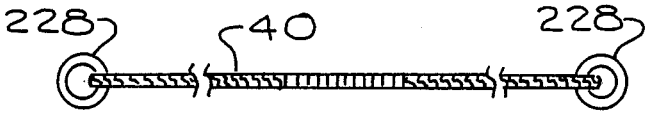
FIG. 17 is a side elevation of a first end support.

A preferred first end support 30 is shown in FIG. 17. The first end support preferably includes a projection 56 for engaging the ground and a base portion 220 for lateral stability. The first end support 30 is preferably an upwardly extending stake or shaft that is angled from the vertical. The first end support 30 will commonly be in front of the golfer substantially in the direction of travel of the golf ball 66. The first end support 30 is preferably positioned such that it angles away from the golfer so that golf balls driven into the first end support 30 will ricochet away from the golfer. A tubular pad 224 can be positioned outside the first end support 30 to cushion the impact of golf balls driven into the first end support to reduce the danger of the golfer or bystanders being injured by ricocheting golf balls.

Figure 18:
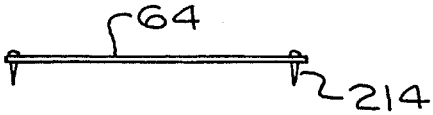
FIG. 18 is a side elevation of flexible guide structure.

The flexible guide 40 shown in FIG. 18 can be conveniently manufactured from a number of materials suitable for this purpose. Heavy elastic cord is preferred. The cord can be formed at its ends into loops 228 which can be used to engage the first end support 30 and second end support 32. It is possible to form the flexible guide from other means, including segmented inelastic materials and to provide alternative means for engaging the end supports. It is possible to use a rigid guide means, but such is not presently preferred.

The apparatus and method of the invention can be modified in many respects without departing from the spirit or essential attributes thereof and accordingly, reference should be made to the following claims, rather than to the foregoing specification, as indicating the scope of the invention.

I claim:

1. A golf instruction apparatus, comprising:

end support means comprising first end support means and second end support means adapted to extend upwardly;

a flexible guide cord adjustably fixed between the end support means; and, adjustor means comprising flexible engagement cord means adapted to engage the guide cord at a plurality of points along said guide cord, said adjustor means further comprising stake means, the stake means including along the length thereof means for attaching the engagement cord means, whereby the engagement cord means can be attached to the stake means at a variety of height above the ground and to a plurality of points along the flexible guide cord, and said guide cord can be positioned at a plurality of heights and angles relative to the ground.

2. The golf instruction apparatus of claim 1, further comprising means for indicating proper club path among the ground.

3. The golf instruction apparatus of claim 2, wherein the means for indicating the proper club path along the ground comprises a club path guide pad, the pad being formed in the shape of an arc corresponding to the proper club path along the ground.

4. The golf instruction apparatus of claim 3, wherein the pad includes means for assisting the golfer in aligning the golf club face.

5. The golf instruction apparatus of claim 13, wherein the means for assisting the golfer in aligning the golf club face along the ground comprises a series of striations substantially along the length of said arc, said striations indicating the proper alignment of the golf club face.

6. The golf instruction apparatus of claim 1, wherein the flexible guide comprises means for indicating length, whereby the golfer can use said means for indicating length to achieve uniform stroke lengths.

7. The golf instruction apparatus of claim 1, wherein at least one of said first and said second end supports comprises padding adapted to absorb the impact of golf balls driven into said front end support.

8. The golf instruction apparatus of claim 1, wherein said first and said second end supports comprise stake means for securing said first and said second end supports to the ground.

9. The golf instruction apparatus of claim 8, wherein said first and said second end support means comprise shaft means fixed to said stake means, said shaft means having detachable means along the length thereof for engaging ends of said flexible guide means.

* * * * *